United States Patent [19]

Bricmont

[11] Patent Number: 5,074,242

[45] Date of Patent: Dec. 24, 1991

[54] AIR KNIFE

[75] Inventor: Francis H. Bricmont, Pittsburgh, Pa.

[73] Assignee: Bricmanage, Inc., McMurray, Pa.

[21] Appl. No.: 556,620

[22] Filed: Jul. 23, 1990

[51] Int. Cl.[5] ..... B05C 11/02

[52] U.S. Cl. ..... 118/665; 118/63; 118/68; 427/8; 427/348

[58] Field of Search ..... 118/63, 65, 66, 67, 118/68, 663, 665, 672, 677; 427/8, 348

[56] References Cited

U.S. PATENT DOCUMENTS

| | | | |
|---|---|---|---|
| 3,190,261 | 6/1965 | Ziffer | 118/665 |
| 3,499,418 | 3/1970 | Mayhew | 118/665 |
| 3,995,478 | 12/1976 | Wilhelm | 118/665 |
| 3,998,181 | 12/1976 | Bellen et al. | 118/665 |
| 3,998,182 | 12/1976 | Mayhew | 118/63 |
| 4,337,725 | 7/1982 | Voelker et al. | 118/665 |
| 4,524,716 | 6/1985 | Mueller | 118/665 |
| 4,655,166 | 4/1987 | Nishimura et al. | 118/63 |

*Primary Examiner*—Willard E. Hoag
*Attorney, Agent, or Firm*—Clifford A. Poff

[57] ABSTRACT

An air knife formed of a plurality of independently controllable pressure chambers for permitting gas in an assortment of differential pressures to be simultaneously discharged from separate segmental portions along the length of the air knife nozzle in order to produce an essentially uniform and desired coating thickness on a continuously moving and continuously coated workpiece regardless of strip thickness, width, camber, and velocity. The air knife includes a plurality of baffles positioned inside the barrel of the air knife for dividing the barrel into at least three distinct pressure chambers. The baffles are adjustably positionable along the length of the barrel in order to establish the desired segmental lengths along the air knife nozzle from which the differentially pressurized gas is discharged from the air knife. In the preferred embodiment, a computer continuously adjusts and controls the pressure in each chamber, and the position of air knife with respect to the workpiece.

18 Claims, 3 Drawing Sheets

AIR KNIFE

BACKGROUND OF THE INVENTION

1. Field of the Invention

The present invention relates generally to apparatus and method for controlling coating thicknesses applied to workpieces and, more particularly, an apparatus and method of operation therefor which will produce an essentially uniform and desired coating thickness across the width of a continuously moving and continuously coated strip-like workpiece regardless of strip thickness, width, camber, and velocity.

2. Description of the Prior Art

In the manufacture of elongated relatively thin, strip-like workpieces such as steel sheet or strip, and the like, the occurrence of a certain degree of camber in the strip across its width is virtually unavoidable. Furthermore, for a multitude of reasons, workpieces such as steel strip are commonly provided with coating before the strip is coiled into a final product.

Coating thickness of galvanizing material, paint, and other materials, on steel or other metal strip production lines is commonly controlled by a device known as an air knife which generally consists of an apparatus which directs an elongated thin pressurized gas jet, typically in the form of air or steam, across the width of the strip in order to control the thickness of coating material which has been freshly deposited on the strip, such as, for example, in an adjacent coating bath or galvanizing pot.

During coating or galvanizing, the strip usually passes under a roll positioned within the bath and then runs vertically upwardly to an upper roll. The air knife is typically located between these rolls and generally adjacent to the coating pot for directing any excess coating back into the pot.

In the usual arrangement, the coating thickness resulting from treatment of the strip by the air knife is then measured by a device above or "downstream" of the air knife. This device operates to transmit signals to the flow control mechanism of the air knife to increase or decrease the pressure of the air or steam in order to maintain a desired and preferably uniform thickness of coating on the strip. In addition to pressure changes, the position of the knife may also be varied.

However, as noted hereinabove, the strip being coated tends to not remain flat as it passes the air knife and usually cambers in a relatively random manner, thereby causing variations in coating thickness across the width of the strip from one to the other longitudinal side edge thereof or, more generally, from the center of the strip to each longitudinal side edge.

An advantage exists, therefore, for an apparatus and method of operation therefor which will provide an essentially uniform and desired coating thickness across the width of a continuously moving and continuously coated strip-like workpiece regardless of strip thickness, width, camber, and velocity.

It is therefore an object of the present invention to provide an apparatus which will produce an essentially uniform and desired coating thickness across the width of a continuously moving and continuously coated strip-like workpiece regardless of strip thickness, width, camber, and velocity.

It is a further object of the present invention to provide a method for producing an essentially uniform and desired coating thickness across the width of a continuously moving and continuously coated strip-like workpiece regardless of strip thickness, width, camber, and velocity.

Still other objects and advantages will apparent in light of the attached drawings and written description of the invention presented herebelow.

SUMMARY OF THE INVENTION

The present invention is directed toward an air knife, and a method of operation therefor, which is formed of a plurality of independently controllable pressure chambers for permitting gas in an assortment of differential pressures to be simultaneously discharged from separate segmental portions along the length of the air knife nozzle in order to produce an essentially uniform and desired coating thickness on a continuously moving and continuously coated workpiece regardless of strip thickness, width, camber, and velocity. The air knife includes a plurality of baffles positioned inside the barrel of the air knife for dividing the barrel into at least three distinct pressure chambers. The baffles are adjustably positionable along the length of the barrel in order to establish the desired segmental lengths along the air knife nozzle from which the differentially pressurized gas, usually in the form of air or steam, is discharged from the air knife. In the preferred embodiment, a computer continuously adjusts and controls the pressure in each chamber and the position of air knife with respect to the workpiece.

DESCRIPTION OF THE PREFERRED EMBODIMENT

Figure 1:
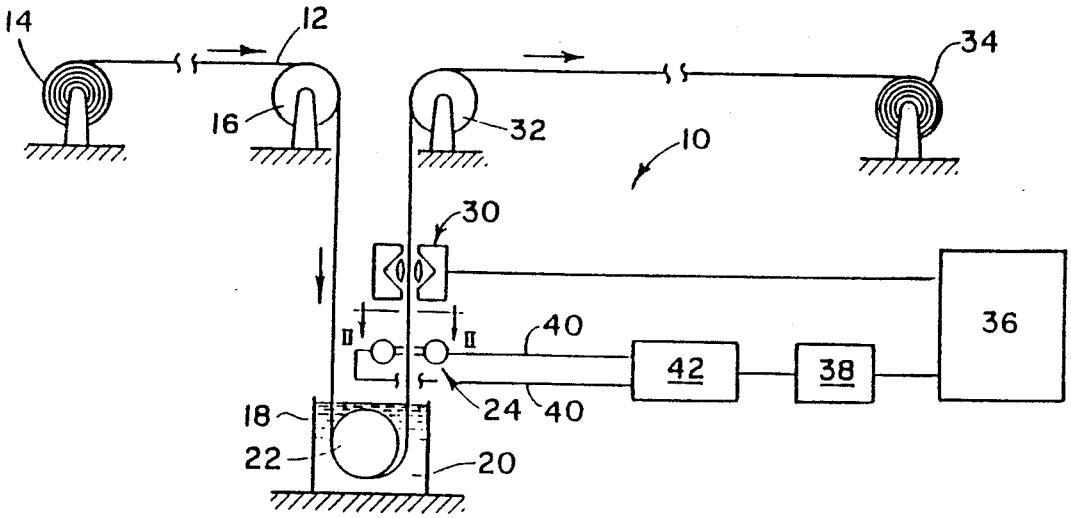
FIG. 1 (PRIOR ART)
FIG. 1 is a schematic representation of a workpiece coating system including a prior art air knife assembly and control system therefor.

With reference to FIG. 1, there is seen a typical prior art system 10 for continuously coating or galvanizing a workpiece or strip 12, in particular, a continuously moving steel or other metallic sheet-like or strip-like workpiece, prior to final coiling thereof. As is conventional, strip 12 is generally supplied from a coil 14 and usually cleaned, pretreated and dried prior to passing through system 10.

During operation of system 10, strip 12 is caused to first pass around a first somewhat elevated rotatable roll 16 and then downwardly toward a coating or galvanizing pot 18 containing a bath 20 of coating material or suitable galvanizing solution. Immersed in bath 20 and rotatably supported by pot 18 is a second rotatable roll 22 around which strip 12 is directed before passing upwardly and entering an air knife assembly 24 for controlling the thickness of coating applied to the strip and for directing excess coating or galvanizing solution back into the bath 20. The air knife assembly 24, perhaps best seen in FIG. 2, typically consists of two opposed air knives 26 directed at opposite sides of strip 12. If preferred, however, it is possible to employ only a single air knife directed at only one side of the strip if it is desired to control the coating thickness on only one side of the strip.

The air knives 26 are typically supported for free floating reciprocating movement in the horizontal direction. That is to say, they are supported by suitable and conventional means (not illustrated) which bias the knives slightly inwardly toward the strip 12 but which permit the knives to translate horizontally away from the strip depending on the magnitude of pressure of air or steam issuing from slit-shaped nozzles 28 of the knives. The pressurized air or steam thus creates "air-cushions" or spacings formed by accumulations of pressurized gas between the knives 26 and the opposite sides of the strip 12, the spacings being directly related to the pressure of the issuing air or steam, e.g., the higher the pressure the greater the spacing between a respective air knife 26 and the side of the strip 12 with which it is associated, and vice versa.

Shortly after treatment by the air knives 26 the strip 12 soon passes detecting means 30, the function of which is described hereinbelow, then usually undergoes a drying or baking operation (not illustrated) normally performed by banks of electric infra-red lamps, gas-fired or electrically heated ovens, or the like, in order to merely drive off excess solvents or, depending upon the composition of the oven atmosphere, oxidize the coating so as to create a durable finish. From the drying or baking operation, the coated strip 12 passes around another rotatable roll 32 whereafter it is cooled and then recoiled into a finished product coil, herein indicated by reference numeral 34. However, if the feed velocity of the strip is sufficiently low, it is possible that the coating may air dry prior to recoiling, thereby avoiding an energy consuming drying operation.

The detecting means 30, which typically consist of at least one x-ray gage, or similar device, serve to measure the thickness of the coating on one or both sides of the continuously moving strip 12 subsequent to its treatment by air knives 26. The detecting means 30 continuously transmit signals corresponding to detected coating thickness data to a computer 36 which interprets the signals and, consequently, continuously instructs a controller 38 to control the output pressures in output lines 40 of a compressor 42 via, for example, controlling an actuator 44 of a valve 45 located in each respective output line 40. As an alternative, depending of course upon the sophistication of the compressed air source 42, the controller 38 may be capable of controlling the output pressures in lines 40 directly at the compressed air source 38, hence avoiding the requirement for separate valves in each output line 40.

Figure 2:
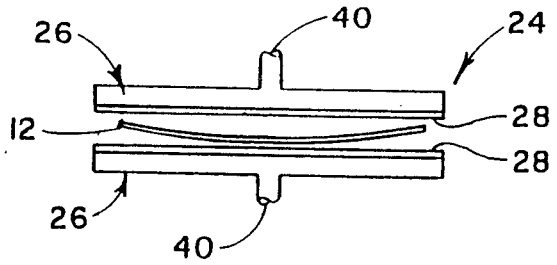
FIG. 2 (PRIOR ART)
FIG. 2 is a view taken along arrows II—II of FIG. 1.
Figure 3:
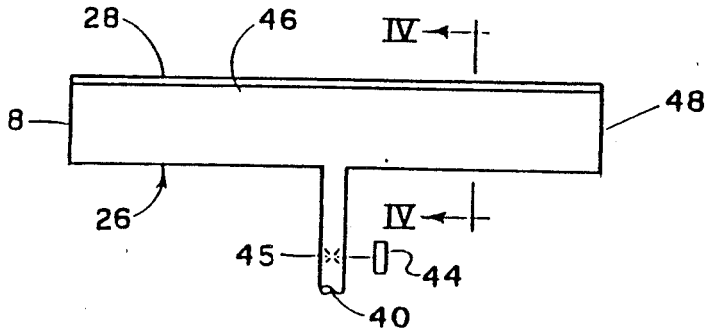
FIG. 3 (PRIOR ART)
FIG. 3 is an enlarged plan view of a single air knife of the air knife assembly depicted in FIG. 2.
Figure 4:
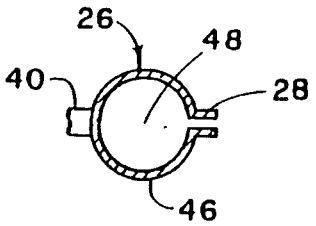
FIG. 4 (PRIOR ART)
FIG. 4 is a view taken along arrows IV—IV of FIG. 3.

As seen in FIGS. 2–4, a single output line 40 communicates with the interior of the barrel 46 of each respective air knife 26 while the opposite ends of the barrel 46 are sealed by end walls 48, thereby forming a single pressure chamber in each air knife. Thus, in an ideal situation wherein the strip 12 is perfectly flat, as a result of the continuous monitoring of the coating thickness by detecting means 30, the pressures within each air knife 26 are continuously varied whereby the thickness of the coating is continuously adjusted to a desired predetermined thickness and the spacings between the air knives 26 and the sides of the strip are also continuously adjusted for providing essentially uniform coating thickness across the width of the strip.

Figure 5:
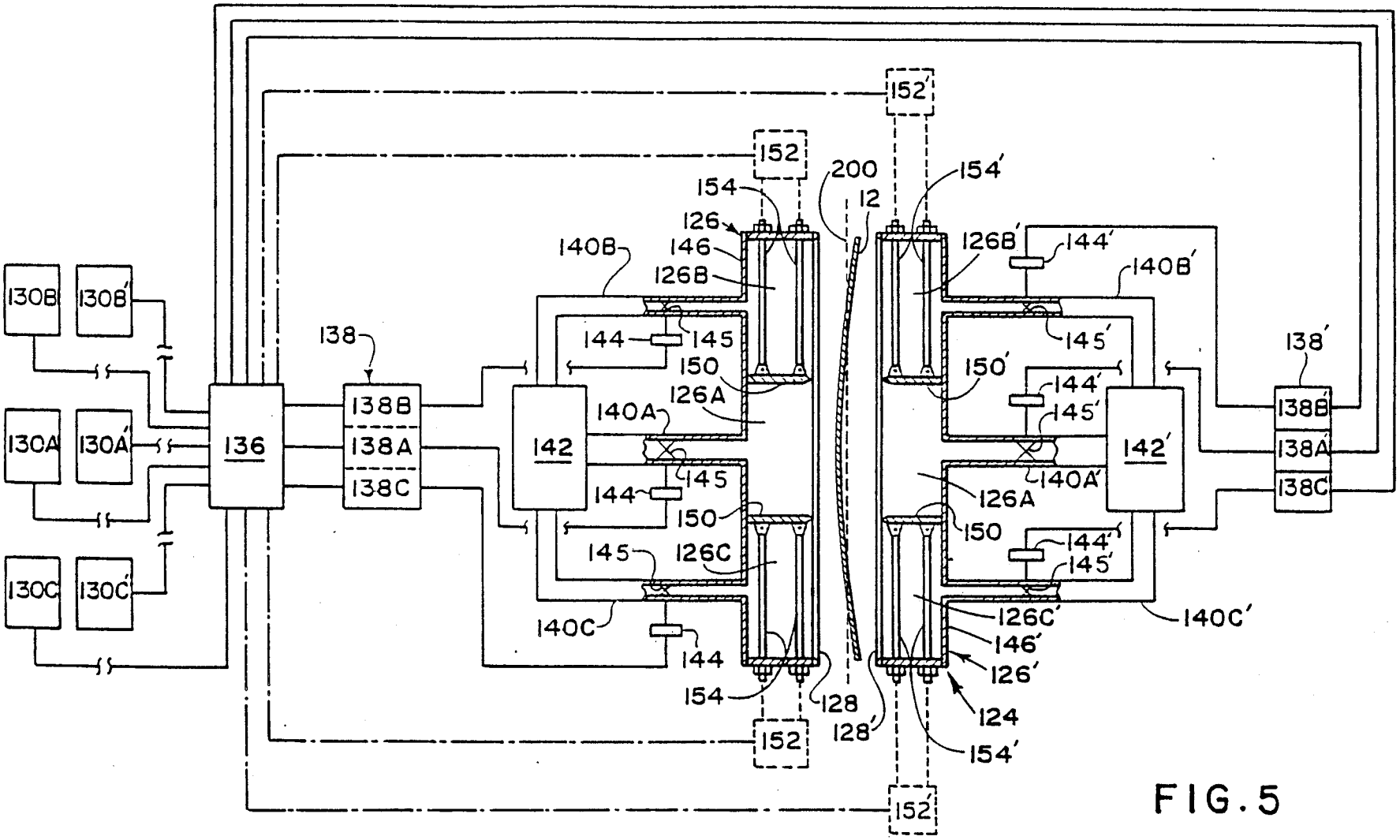
FIG. 5 is a combination schematic and partial sectional representation of the air knife assembly of the present invention and the control system therefor.

Such is not the case, however, in practice wherein uncoiled elongated metallic strip, due to dimensional factors, inherent material strength factors, and other related physical conditions, is invariably afforded with a degree of relatively random curvature or camber across its width which, for purposes of illustration only, is greatly exaggerated in FIGS. 2 and 5. It is this camber which prevents existing air knife assemblies from providing uniform coating thickness across the entire width of one or both sides of continuously moving and continuously coated strip.

As will by now be appreciated, since each air knife 26 is provided with pressurized air or steam from a single source, i.e., its respective output line 40, the pressure within the air knife barrel 46 is uniform throughout its length. Therefore, the pressure of the air or steam discharged from slit-shaped nozzle 28 is uniform along the length of the nozzle. The resulting effect is that, with respect to each air knife 26, a first quantity of coating material is removed from the central regions of the strip 12 while, depending on the direction of camber of the strip, more or less coating material is removed from the edge regions. Hence, the uniformly pressurized air or steam pressure which is expelled from each respective nozzle 28 is relatively ineffective for ensuring an essentially uniform thickness of coating across the width of the cambered strip.

Turning to FIG. 5, there is seen a combination schematic and partial section view of the preferred embodiment of the improved air knife assembly 124 of the present invention. Preferably, assembly 124 consists of two opposed air knives 126 for coating each side of strip 12, although a single air knife may be used if it is desired to control the coating thickness of only one side of the strip.

Except where otherwise indicated, for purposes of simplicity, only the left air knife 126 illustrated in FIG. 5 and its associated components will be described in detail, it being understood that the right air knife 126' and its associated components, which are designated by numerals bearing prime symbols, are identical in structure and function to those of the left air knife 126 Furthermore, air knives 126 and 126', like air knives 26, are also supported by suitable and conventional means (not illustrated) for free floating reciprocating movement in the horizontal direction toward and away from opposite sides of strip 12.

The interior of the barrel 146 of the air knife 126 of the present invention is divided into a plurality of separate and differentially pressurizable pressure chambers, and, most preferably, into a central chamber 126A and at least two outer pressure chambers 126B and 126C, by the presence of at least two adjustable baffle members 150 which are slidably carried in barrel 146, the outer peripheries of the baffle members 150 forming air-tight seals with the inner surface of barrel 146. The positions at which adjustable baffle members 150 are set in barrel 146 establishes the desired segmental lengths along the nozzle 128 from which differentially pressurized air from chambers 126A, 126B, 126C, and the like, is discharged from the air knife 126. Although for purposes of clarity only two baffle members 150 are shown within each air knife 126, it will be understood that greater than two such baffle members may provided in barrel 146 in order to form more than three differentially pressurizable chambers in air knife 126 if such is preferred or necessary.

Prior to the start of a coating run, the desired positions of baffle members 150 may be set either manually or by mechanical means to be described hereinbelow.

According to the present invention, each pressure chamber within barrel 146 is individually connected to pressurized air or steam supplied from a compressor 142 via individual output lines from the compressor. For example, in the illustrated and preferred embodiment of FIG. 5, pressure chambers 126A, 126B and 126C of each air knife 126 are individually connected to compressor output lines 140A, 140B and 140C, respectively.

Also, in accordance with the present invention, each pressure chamber is assigned an individual adjustably positionable detecting means. In the preferred embodiment, the detecting means are x-ray gages and are indicated by reference numerals 130A, 130B, 130C, 130A', 130B' and 130C'. During operation, the detecting means, which are slightly downstream of the air knives 126 and 126', monitor the coating thickness at spaced locations across the width of the strip 12. For example, when facing strip 12 from left air knife 126, detecting means 130B is positioned above and generally centrally of the left chamber 126B, detecting means 130A is positioned substantially at the same height as detecting means 130B and centrally of strip 12 (and central chamber 126A), and detecting means 130C is positioned above and generally centrally of the right chamber 126C.

The coating thickness data continuously gathered by the monitoring of detecting means 130A, 130B and 130C is transformed into corresponding signals that are continuously transmitted to a computer 136 which interprets the signals and, consequently, continuously instructs a three-circuit controller 138 having control circuits 138A, 138B and 138C to control the output pressures in output lines 140A, 140B and 140C, respectively. For example, respective controller circuits 138A, 138B and 138C may be used to control a corresponding actuator 144 of a valve 145 located in each compressor output line 140A, 140B and 140C for individual pressure control in each output line and, consequently, individual pressure control of pressure chambers 138A, 138B, and 138C. As will be appreciated, data signals from detecting means 130A', 130B' and 130C' are also transmitted to computer 136 which operates controller 138' in similar fashion to controller 138 in order to individually control the pressure in lines 140A', 140B' and 140C', thereby individually controlling the pressure in chambers 126A', 126B' and 126C' It should be understood that the separate controllers 138,.138' and separate compressors 142, 142' may be suitably replaced with a single controller and a single compressor, if desired.

As stated hereinabove, prior to a workpiece coating run, the positions of baffle members 150 may either be manually set or set by suitable mechanical means. As depicted in phantom lines in FIGS. 5, these means, which are designated by numerals 152 and 152', preferably include drive motor means for moving spaced rod members 154, 154' which pass through the end walls of air knives 126, 126' and which are pivotally or universally attached to baffle members 150, 150'. Although a single rod member 154 or 154' may be suitably attached to each baffle member and constant-sized baffle members may be employed, for purposes of optimum control of chamber volumes, chamber nozzle lengths, and the like, it is most preferred that two such rod members 154 and 154' be attached to each baffle ember 150 or 150' and that the baffle members be capable of self-expansion and self-contraction so that the respective rod members for each baffle member may be differentially extended or retracted by motor means 152 and 152' whereby the planes of the baffle members may be adjusted to orientations that may not be perpendicular to the axial direction of the knife barrels 146, 146. Moreover, if motor means 152 and 152' are used to extend and react rod members 154, and 154', it is preferred that the motor means also be caused to operate by signals from the computer 136 which is capable of interfacing with an operator who may thereby program the exact desired positions of the baffle members into the computer prior to the start of a run.

The initial preparation of the air knife 126 (and air knife 126') of the present invention prior to the start of a coating run of strip 12 is as follows. Depending on the thickness and maximum camber of strip 12, the exposed outer edge of nozzle 128 is positioned such that it will just permit clearance of the most severely cambered surfaces of strip 12. The baffle members 150 are then set to their desired positions along barrel 146 which depend on both strip width and degree of camber. For best results, it is preferred to position the baffles at locations which substantially correspond to intersections between the actual camber of the strip and the mean position of the actual camber, herein represented by dashed line 200 in FIG. 5. The mean position of the actual camber may also be considered to be the central lateral axis of the strip 12 in the ideal situation wherein the strip is perfectly flat. As previously noted, the positions of the baffle members establish the desired segmental lengths along the nozzle from which differentially pressurized air is discharged from chambers 126A, 126B and 126C. The x-ray gages 130, 130B and 130C are then set to their desired positions, i.e., downstream and generally centrally of chambers 126A, 126B and 126C; and the air knife assembly 124 including air knife 126 and the similarly prepared air knife 126', if also used, is ready for operation.

At start-up, the pressure in chamber 126A is set to a predetermined pressure which will remove any excess quantity of coating from a generally central region of the strip above that of a predetermined desired thickness. The pressure in chamber 126A is also used to establish the desired "air cushion" spacing between the air knife and the strip 12. The computer 136, responding to signals from the x-ray gages 130A, 130B and 130C which indicate any variations from the predetermined desired coating thickness, then serves to operate control circuits 138A, 138B, and 138C in accordance with detection of coating thickness variance in any region along the width of the strip. For example, in FIG. 5, from the perspective of air knife 126, it is seen that due to the illustrated camber in strip 12, the strip is closer to the air knife 126 in its central region and further from the air knife 126 nearer its outer or edge regions. Accordingly, due to this spacing differential, the pressures in chambers 126B and 126C will have to be increased to pressures above that of the pressure in chamber 126A in order to provide their discharged air or steam jets with sufficient velocity to maintain the coating thickness at the more distantly spaced outer regions of the strip at the same level as the more closely spaced central region thereof. The situation described above, as will be understood, is reversed for air knife 126'. Also, since the instantaneous camber or curvature of a strip-like metallic workpiece is somewhat catenary and symmetrical in shape, the absolute values of the differential pressures in chambers 128B and 128C relative to that of chamber 128A are in most cases nearly identical to one another.

It will be also understood that the situation depicted in FIG. 5 is a single instant or "snapshot" of the preferably continuous operation of the air knife assembly of the present invention. In other words, due to the usually random camber of the continuously moving strip 12, the orientation and/or magnitude of the camber of the strip, and thus the operating parameters for air knives 126 and 126', may quickly and materially change in a very brief interval of time and/or strip travel distance. However, because of the continuous transmission of coating thickness data signals to the computer 136 from the x-ray gages which are spaced from one another across the width of the strip on one or both sides thereof, the apparatus and method of the present invention is capable of continuously producing an essentially uniform and desired coating thickness across the entire width of the continuously moving strip on one or both sides thereof regardless of strip thickness, width, camber and velocity.

Figure 6:
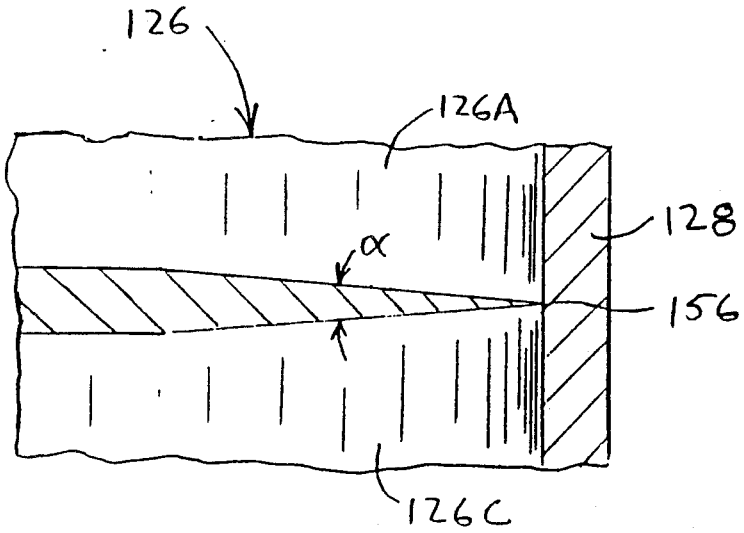
FIG. 6 is an enlarged view of a portion of the air knife assembly illustrated in FIG. 5.

FIG. 6 depicts on an enlarged scale the preferred configuration of the downstream edge of a baffle member 150, i e. the edge portion of baffle member 150 spanning the width of the opening in the flow passage of the nozzle 128. Although the preferred configuration of the downstream edge portion of only one baffle member 150 is shown, it will be understood that it is most desirable that the downstream edge portions of all of the baffle members 150 and 150' in air knives 126 and 126' assume the preferred configuration shown in FIG. 6.

In particular, it is preferred that the downstream edge portion 156 which spans the width of the opening in the flow passage of the nozzle 128 be formed, for example, as by grinding one or both sides the baffle member, into a pointed edge much like an ax or knife edge. It is even further preferred that the downstream edge portion 156 form the apex of an acute angle $\alpha$, preferably on the order of about 5°. Such a shallow angle ensures that at downstream edge portion 156, the baffle member possesses essentially no thickness and, further, that because of the gradual angle of divergence from edge 156 pressurized air or steam is discharged uninterrupted along the length of the opening of the nozzle 128. That is to say, there are no detectable interstices along the length of the opening of the nozzle 128 where no pressurized air is discharged, hence the formation of lines of raised coating along the length of workpiece 12 are effectively avoided.

Although the air knife assembly 124 and control system therefor has been shown for specific use in controlling the coating thickness of dipped-coated strips, the air knife assembly 124 and its associated control system may also be effectively adapted for controlling the thickness of brushed, sprayed, rolled or otherwise coated continuously moving strips.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. Apparatus for producing an essentially uniform and desired coating thickness across the width of a continuously moving freshly coated strip workpiece regardless of strip thickness, width, camber, and velocity, said apparatus comprising:

means for automatically controlling the operation of at least one air knife; and at least one air knife associated with said means for automatically controlling, said at least one air knife being supported for reciprocating horizontal translation toward and away from a first side of a vertically oriented segment of said continuously moving strip and positioned downstream of a location at which said continuously moving strip is coated, said least one air knife including:

an elongated barrel having first and second closed ends and extending lengthwise across the width of said continuously moving strip;

an elongated nozzle extending for substantially the entire length of said elongated barrel; and means for forming a plurality of differentially pressurizable chambers within said elongated barrel, whereby differentially pressurized gas discharged through said nozzle from said differentially pressurizable chambers controls the thickness of coating applied to said continuously moving strip in order to produce an essentially uniform and desired coating thickness across the width of said first side of said strip.

2. The apparatus of claim 1 wherein said means for forming a plurality of differentially pressurizable chambers comprise a plurality of baffle members carried within said barrel, said baffle members dividing said barrel into a central chamber and at least two outer chambers, said baffle members further establishing at least three segmental lengths along said nozzle from which differentially pressurized gas from said central chamber and said at least two outer chambers is separately discharged.

3. The apparatus of claim 2 further comprising means for adjustably positioning said baffle members along the length of said barrel, said means for adjustably positioning serving to vary the segmental lengths along said nozzle form which the differentially pressurized gas from said central chamber and said outer chambers is discharged.

4. The apparatus of claim 3 wherein each of said central chamber and said outer chambers is connected to a separate source of pressurized gas, said means for automatically controlling the operation of said at least one air knife including means for controlling the gas pressure supplied to each of said central chamber and said outer chambers by said separate sources of pressurized gas.

5. The apparatus of claim 4 wherein the means for controlling the gas pressure supplied to each of said central chamber and said other chambers by said separate sources of pressurized gas comprise means situated downstream of said at least one air knife for detecting coating thicknesses on said strip at at least three spaced locations along the width of said strip along said first side, one of each of said means for detecting being in generally vertical alignment with a midpoint of one of said at least three segmental lengths along said nozzle.

6. The apparatus of claim 5 wherein the means for controlling the gas pressure supplied to each of said chambers by said separate sources of pressurized gas further comprise a computer and at least one controller operated by said computer, said computer continuously receiving and interpreting detected coating thickness data signals continuously transmitted from said means for detecting and, in response to the continuously received signals, continuously instructing said at least one controller to control the gas pressures supplied to said central chamber and said outer chambers by said separate sources of pressurized gas in order to maintain the applied coating essentially at said uniform and desired coating thickness across the width of said strip.

7. The apparatus of claim 6 further comprising a second air knife associated with said means for controlling, said second air knife being supported for reciprocating horizontal translation toward and away from a second side of the substantially vertically oriented segment of said continuously moving strip at a position substantially opposite to said at least one air knife, said second air knife including:

an elongated barrel having first and second closed ends and extending lengthwise across the width of said continuously moving strip;

an elongated nozzle extending for substantially the entire length of said elongated barrel; and means for forming a plurality of differentially pressurizable chambers within said elongated barrel, whereby differentially pressurized gas discharged through said nozzle from said differentially pressurizable chambers controls the thickness of coating applied to said continuously moving strip in order to produce an essentially uniform and desired coating thickness across the width of the second side of said strip.

8. The apparatus of claim 7 wherein said means for forming a plurality of differentially pressurizable chambers within said elongated barrel of said second air knife comprise a plurality of baffle members carried within said barrel of said second air knife, said baffle members dividing said barrel of said second air knife into a central chamber and at least two outer chambers, said baffle members of said second air knife further establishing at least three segmental lengths along said nozzle of said second air knife from which differentially pressurized gas from said central chamber and said at least two outer chambers of said second air knife is separately discharged.

9. The apparatus of claim 8 further comprising means for adjustably positioning said baffle members of said second air knife along the length of said barrel of said second air knife, said means for adjustably positioning said baffle members of said second air knife serving to vary the segmental lengths along said nozzle of said second air knife from which the differentially pressurized gas from said central chamber and said outer chambers of said second air knife is discharged.

10. The apparatus of claim 9 wherein each of said central chamber and said at least two outer chambers of said second air knife is connected to a separate source of pressurized gas, said means for automatically controlling further including means for controlling the gas pressure supplied to each of said central chamber and said outer chambers of said second air knife by said separate sources of pressurized gas.

11. The apparatus of claim 10 wherein the means for controlling the gas pressure supplied to each of said central chamber and said outer chambers of said second air knife by said separate sources of pressurized gas comprise means situated downstream of said second air knife for detecting coating thicknesses on said strip at at least three spaced locations along the width of said strip at said second side, one of each of said means for detecting situated downstream of said second air knife being in generally vertical alignment with a midpoint of one of said at least three segmental lengths along said nozzle of said second air knife.

12. An air knife for producing an essentially uniform and desired coating thickness across a surface of a freshly coated workpiece, said air knife comprising:

an elongated barrel having first and second closed ends;

an elongated nozzle extending for substantially the entire length of said elongated barrel;

means for forming a plurality of differentially pressurizable chambers within said elongated barrel; and means for differentially pressurizing said plurality of differentially pressurizable chambers, whereby differentially pressurized gas discharged through said nozzle from differentially pressurizable chambers controls the thickness of the coating applied to said workpiece in order to produce an essentially uniform and desired coating thickness across said surface of said workpiece.

13. The air knife of claim 12 wherein said means for forming a plurality of differentially pressurizable chambers comprise a plurality of baffle members carried within said barrel, said baffle members dividing said barrel into a central chamber and at least two other chambers, said baffle members further establishing a least three segmental lengths along said nozzle from which differentially pressurized gas from said central chambers and said at least two outer chambers is separately discharged.

14. The air knife of claim 13 further comprising means for adjustably positioning said baffle members along the length of said barrel, said means for adjustably positioning serving to vary the segmental lengths along said nozzle from which the differentially pressurized gas from said central chamber and said outer chambers is discharged.

15. The air knife of claim 14 wherein each of said central chamber and said at least two other chambers is connected to a separate source of pressurized gas, said means for differentially pressurizing including means for controlling the gas pressure supplied to each of said central chamber and said outer chambers by said separate sources of pressurized gas.

16. A method for producing an essentially uniform and desired coating thickness across the width of a continuously moving freshly coated strip workpiece regardless of strip thickness, width, camber, and velocity, said method comprising the steps of:

applying differentially pressurized gas simultaneously to a plurality of regions across the width of said continuously moving freshly coated strip;

detecting a plurality of coating thicknesses across the width of said strip subsequent to said step of applying differentially pressurized gas; and controlling the pressure of said differentially pressurized gas applied to said plurality of regions in response to said step of detecting a plurality of coating thicknesses, whereby the differentially pressurized gas controls the thickness of coating freshly applied to said strip in order to produce an essentially uniform and desired coating thickness across the width of said strip.

17. The method of claim 16 wherein said step of detecting comprises continuously detecting a plurality of coating thicknesses across the width of said strip, and said step of controlling comprises continuously controlling the pressure of said differentially pressurized gas applied to said plurality of regions.

18. The method of claim 17 wherein said step of applying differentially pressurized gas comprises applying differentially pressurized gas to a central region and at least two outer regions across the width of said strip, and said step of detecting a plurality of coating thicknesses across the width of said strip comprises detecting a coating thickness associated with said central region and detecting a coating thickness associated with each of said at least two outer regions.

* * * * *